US009139959B2

(12) United States Patent
Bösterling et al.

(10) Patent No.: US 9,139,959 B2
(45) Date of Patent: Sep. 22, 2015

(54) SYSTEM FOR FASTENING A RAIL IN PLACE AND FASTENING FOR A RAIL

(75) Inventors: Winfried Bösterling, Neuenrade (DE); Lutz Rademacher, Lüdenscheid (DE); Adrian Bednarczyk, Lüdenscheid (DE)

(73) Assignee: Vossloh-Werke GmbH, Werdohl (DE)

( * ) Notice: Subject to any disclaimer, the term of this patent is extended or adjusted under 35 U.S.C. 154(b) by 410 days.

(21) Appl. No.: 13/387,218

(22) PCT Filed: Sep. 14, 2010

(86) PCT No.: PCT/EP2010/063454

§ 371 (c)(1),
(2), (4) Date: Apr. 11, 2012

(87) PCT Pub. No.: WO2011/032932

PCT Pub. Date: Mar. 24, 2011

(65) Prior Publication Data

US 2012/0187206 A1 Jul. 26, 2012

(30) Foreign Application Priority Data

Sep. 15, 2009 (DE) ..... 10 2009 041 112

(51) Int. Cl.

| | |
|---|---|
| ***E01B 9/62*** | (2006.01) |
| ***E01B 13/02*** | (2006.01) |
| ***E01B 9/30*** | (2006.01) |
| ***E01B 9/66*** | (2006.01) |

(52) U.S. Cl.
CPC .. *E01B 9/303* (2013.01); *E01B 9/66* (2013.01)

(58) Field of Classification Search
USPC ..... 238/264, 265, 310, 315, 316, 338–343, 238/349, 351
See application file for complete search history.

(56) References Cited

U.S. PATENT DOCUMENTS

| | | | | |
|---|---|---|---|---|
| 5,096,119 | A | 3/1992 | Schultheiss et al. | |
| 6,257,495 | B1 | 7/2001 | Eisenberg | |
| 2008/0105758 | A1 * | 5/2008 | Schwiede et al. | 238/349 |
| 2008/0237363 | A1 | 10/2008 | Hauschild et al. | |
| 2010/0280720 | A1 | 11/2010 | Huber | |
| 2010/0308123 | A1 | 12/2010 | Bosterling | |
| 2011/0042475 | A1 | 2/2011 | Bösterling et al. | |

FOREIGN PATENT DOCUMENTS

| | | | |
|---|---|---|---|
| CN | 1049881 | A | 3/1991 |
| CN | 2144138 | Y | 10/1993 |
| CN | 2151170 | Y | 12/1993 |

(Continued)

*Primary Examiner* — R.J. McCarry, Jr.
(74) *Attorney, Agent, or Firm* — The Webb Law Firm

(57) ABSTRACT

A system includes a guide plate, a fastening member and a resilient member, for fastening a rail on a solid base. The guide plate serves as a guide for the rail in the horizontal direction and as a stop for movements of the rail in the vertical direction. The guide plate has a contacting surface against which the longitudinal side of the foot of the rail rests. The resilient member which rests on the guide plate exerts substantially no hold-down force on the rail and merely supports the guide plate elastically against the clamping member. The resilient member is of a W-shaped or S-shaped configuration and, in the fitted state, a portion thereof projects sufficiently far over the foot of the rail for it to be retained resiliently by the resilient member if it is moved upwards in the vertical direction.

19 Claims, 4 Drawing Sheets

(56) References Cited

FOREIGN PATENT DOCUMENTS

| | | | |
|---|---|---|---|
| CN | 2281998 | Y | 5/1998 |
| CN | 1216078 | A | 5/1999 |
| CN | 1985050 | A | 6/2007 |
| CN | 101481892 | A | 7/2009 |
| DE | 2810618 | B1 | 9/1979 |
| DE | 19848928 | A1 | 5/2000 |
| EP | 1693514 | A2 | 8/2006 |
| TW | 200815646 | A | 4/2008 |
| TW | 200920897 | A | 5/2009 |
| TW | 200925353 | A | 6/2009 |
| WO | 2006061234 | A1 | 6/2006 |
| WO | 2009101457 | A1 | 8/2009 |

* cited by examiner

SYSTEM FOR FASTENING A RAIL IN PLACE AND FASTENING FOR A RAIL

BACKGROUND OF THE INVENTION

1. Field of the Invention

The invention relates to a system for fastening a rail in place on a base and to a fastening for a rail which uses such a system.

2. Description of Related Art

When rails are to be fastened in place on which travel takes place with quite low loads and at quite low speeds, as is the case with tramways for example, the primary concerns are on the one hand wear which is as low as possible and on the other hand a comfortable ride and the minimising of emitted sounds. At the same time, such fastenings are also intended to be able to be fitted easily and to be able to be manufactured inexpensively.

In the rail fastenings which are used in practice, these requirements are met by mounting the rails on a solid base formed for example by a concrete sleeper or an isolated support made of concrete, with an elastic layer having a defined ability to yield being arranged between the foot of the rail and the solid base. The ability to yield of the elastic layer is selected in this case in such a way that, when travel takes place along the rail, the behaviour of the rail in the region of the given fastening is the same as it is in the unsupported region between two fastenings which is spanned by the rail in an unfastened state.

In the case of rail fastenings of this kind, the job of the fastening is to secure the rail in position in the horizontal direction at right angles to the longitudinal extent thereof and to prevent the rail from lifting away from the elastic layer in the vertical direction.

In a rail fastening system which is known from DE 198 48 928 A1, the rail stands an a substantially C-shaped elastic mounting profile which fits round the sides of the foot of the rail and which rests on a sleeper composed of concrete. This arrangement is intended to ensure low-noise, damped running of trams on the rail. To hold down the rail, use is made of clamping profiles which are fixed in place by means of respective fastening screws screwed into the sleeper. The clamping profiles have in this case a fastening portion which is supported on the sleeper and on which there is integrally formed a projection which, in the fitted state, presses against the free upper side of the foot of the rail. To make it possible for the gauge to be adjusted at the same time, there are provided in addition in this known system, trapezoidal gauge-defining profiles which are displaceable at lateral gauge-defining edges of the rail supports of the sleeper and which have slotted holes parallel to the longitudinal direction of the rails for the fastening screws. In this way, the gauge-defining profiles form guides in the transverse direction which are adjustable in the horizontal direction for their respective associated rails.

Something which has proved to be a problem in the practical use of rail fastenings of the kind explained above is the fact that the fastening screws come loose, meaning that the fastening requires maintenance after operating for only a comparatively short period.

SUMMARY OF THE INVENTION

Against this background, the object to be achieved by the invention was to provide a system for fastening a rail in place which was not only easy to fit but also, at the same time, would ensure that the rail was securely held for a longer period of operation. As well as this, it was also the intention to provide a fastening designed in a corresponding way for a rail.

In accordance with the invention, this object has been achieved, as far as the system is concerned, by a system for fastening a rail in place which is designed as described herein. Advantageous embodiments of the system according to the invention are also described herein.

As far as the fastening is concerned, the object stated above has been achieved in accordance with the invention by virtue of the fact that this fastening is designed as described herein. Advantageous embodiments of a fastening according to the invention are also described herein.

A system according to the invention for fastening a rail in place on a base which may be formed by, in particular, a sleeper made from concrete or a comparably solid material or a corresponding isolated support comprises a guide plate, a fastening member and a resilient member.

The guide plate serves on the one hand as a guide for the rail in the horizontal direction. On the other hand, in conjunction with the resilient member, it forms, in the fitted position, a stop for movements of the rail in the vertical direction.

The guide plate has a supported surface by which it is supported on the base in the fitted position. Either the guide plate may rest directly on the base in this case or, if this is found to be necessary, a further layer, which serves to provide elastic support or protection against wear for example, may be present between the base and the guide plate.

For the lateral, horizontal guidance of the rail, the guide plate also has a contacting surface against which the longitudinal side of the foot of the rail rests in the fitted position.

Finally, there is also formed in the guide plate of a system according to the invention a through-opening, which runs from its upper side to its supported surface, for a clamping member which is inserted through the through-opening in the guide plate to be fastened into the base.

The clamping member is used to clamp in place a resilient member bent from spring wire which applies an elastic hold-down force to the guide plate in the fitted position. At the same time the resilient member acts as a sort of stop by which a limit is set to the vertical movements which the rail makes when a rail-borne vehicle travels along it.

To perform this dual function, the resilient member has at least one portion acting in torsion at one end of which is formed a first supporting portion aligned at an angle to the portion acting in torsion and at the other end of which is formed a further supporting portion bent round from the portion acting in torsion. The length and angular position of the first supporting portion relative to the portion acting in torsion are of a size such, in this case, that in the fitted position the first supporting portion of the resilient member is supported on an associated support surface on the upper side of the guide plate and the resilient member is braced against the base by means of the clamping member in such a way that the portion acting in torsion exerts an elastic restorative force. When the resilient member is not braced, the first supporting portion thus points away from the portion acting in torsion at an angle in such a way that, in the braced state, it exerts on the portion acting in torsion a torque by which the portion acting in torsion is twisted. At the same time, the length of the portion acting in torsion is of a size such that, in the fitted position, that end of the portion acting in torsion which is associated with the further supporting portion projects beyond the contacting surface of the guide plate towards the rail. In this way, the portion acting in torsion is sufficiently long to ensure that, in the fitted state, it has the requisite elasticity to hold down the guide plate. The second supporting portion which is connected to the portion acting in torsion is so shaped for this purpose that it is likewise supported on the guide plate in the fitted position and forms a fixed point for the torsion on the portion acting in torsion.

At the same time, that portion of the portion acting in torsion which projects beyond the contacting surface of the guide plate forms, as a support, a stop for the vertical movements of the rail.

What is thus achieved by the shaping according to the invention of the guide plate and resilient member is elastically yielding support for the foot of the rail in the vertical direction directed perpendicularly to the given base, in which support the hold-down forces exerted on the foot of the rail are determined solely by the force with which the further supporting portion projecting over the foot of the rail presses on the foot of the rail. In this way, it is easily possible in a system according to the invention for the shape of the guide plate and the position of the resilient member to be matched to one another in such a way that hold-down forces which are at most minimal and in particular are non-existent are exerted on the foot of the rail in the unloaded fitted state.

This latter fact is found to be particularly useful when there is inserted between the foot of the rail and the solid base an elastic interlayer which ensures that the rail has a defined ability to yield when travel takes place over the given fastening. For this purpose, the distance between the underside of the projection, which underside is associated with the foot of the rail which is to be fastened in place, and the supported surface of the guide plate may, in a fastening according to the invention or in other words in a system according to the invention, be substantially the same as the distance between the free surface of the foot of the rail and the surface of the solid base.

To ensure that the resilient member, which is usually made of a conductive spring steel, is electrically insulated from the rail to be fastened in place, an insulating member composed of a non-conductive material may be provided which, at a fastening point fully assembled from a system according to the invention, is arranged between the foot of the rail and that region of the resilient member which projects over the foot of the rail. To make it easier for this insulating member to be fitted, the insulating member may be provided with a latching arrangement by means of which it can be latched onto that region of the resilient member which is associated with it.

The hold-down forces which are exerted on the foot of the rail by the resilient member in the fitted state when the rail is not under load, which are low in accordance with the invention, may be precisely proportioned in a particularly easy way by integrally forming on the guide plate at least one projection which projects over the contacting surface towards the associated rail. This projection is then so shaped and arranged that it projects over the free upper side of the foot of the rail in the fitted position, rests thereon in particular with a low hold-down force or no hold-down force at all and, this being the case, forms the stop for the vertical movements of the rail. In the event of the guide plate being composed of a non-conductive material, the projection acts at the same time as an insulator which insulates the resilient member from the foot of the rail. To stop any damage from occurring to the guide plate in the event of excessively large vertical movements by the rail, an intended break-point may be provided in the region of the transition from the projection to the guide plate. A fracture having occurring at the intended break-point, the projection continues to act as an insulator and continues to ensure that the hold-down forces applied by the resilient member are distributed over a large area of the foot of the rail.

In a system according to the invention, that region of the resilient member which, in the form of the further supporting portion, projects over the foot of the rail in the fitted state, thus sets a resilient elastic limit to the vertical movements which the rail makes in operation, without any major hold-down forces being exerted on the rail in this case when the latter is in the unloaded state. The rail thus has a comparatively large amount of free resilient travel in the vertical direction but is nevertheless secured against the movements which it is caused to make when a load is applied by a rail-borne vehicle becoming too large.

Where the solid base is formed by sleepers or isolated supports, the elastic layer is preferably so designed that, when a rail-borne vehicle travels over the rail in the region of the fastening formed with the help of a system according to the invention, the rail sinks at least approximately as much as it does in the regions between two sleepers where it is not supported.

Where the guide plate is provided with the projection explained above which supports the resilient member, if the projection, and with it the guide plate, is stressed as a result of a movement of the rail directed in the vertical direction, this stress is damped by the resilient member with the result that impact stresses are kept away from the clamping member. In this way, the risk of any premature loosening of the bracing of the guide plate onto the solid base produced by the clamping member is reduced to a minimum.

The invention thus makes available a fastening system which, with a very small number of components, ensures lastingly secure guidance for rails which are intended in particular for tramway traffic or comparable applications. The small number of parts not only makes the system according to the invention particularly easy to fit but also allows such a system to be produced particularly inexpensively.

That portion of the portion acting in torsion of the resilient member which projects beyond the contacting surface can, in a particularly effective way, be used as a support for the stop formed by the projection which may be present on the guide plate as an option if, in the fitted position, at least the further supporting portion or the portion acting in torsion rests on the projection from the guide plate and if the projection has, on its free upper side remote from the supported surface of the guide plate, at least one guide for the further supporting portion or the portion acting in torsion.

By giving the guide plate, on its opposite side from the contacting surface, a support surface of which the imaginary extension in its longitudinal direction intersects the contacting surface at an acute angle, and by forming on the solid base a shoulder against which the guide plate is supported by its support face in the fitted position, setting of the gauge cab easily be undertaken even with a system according to the invention. This can be done particularly easily if the through-opening in the guide plate takes the form of a slotted hole whose longitudinal axis is aligned parallel to the longitudinal axis of the support surface. In this case, the guide plate can be secured to an additional degree in the position corresponding to the gauge which is desired in the given case by forming keying surfaces in the upper side of the guide plate, thus enabling the resilient member to be supported in one of the keying surfaces in the fitted position as a function of the given position of the guide plate relative to the clamping member.

The guide plate is preferably made of an electrically insulating material such for example as a plastics material. Not only does this allow particularly easy and inexpensive manufacture but it also allows the rail to be fastened in place in such a way as to be insulated in its entirety from the solid base.

What may be used as a clamping member is a screw whose head, in the fitted position, acts on the portion acting in torsion of the resilient member. In a system according to the invention, use may of course equally well be made of a stud onto which a nut is screwed to brace the resilient member or of some other clamping member suitable for generating clamping forces of an adequate size.

An embodiment of the invention which is particularly easy to fit and at the same time functional is characterised in that the longitudinal axis of the further supporting portion of the resilient member extends in the same plane as the longitudinal axis of the portion acting in torsion.

An embodiment of the resilient member which is particularly well suited to practical needs with regard to the resilient elastic limiting of the vertical movements of the rail is obtained if the resilient member has a second portion acting in torsion arranged at a distance from the first portion acting in torsion, if the second portion acting in torsion, like the first portion acting in torsion, merges at one of its ends into a supporting portion which is aligned at an angle to the second portion acting in torsion and which causes a torsion on the associated portion acting in torsion in the fitted position, and if the second portion acting in torsion is connected at its other end to that end of the further supporting portion which is remote from the first portion acting in torsion.

When this is the case, the resilient member is of shape where the portions acting in torsion and the supporting portions integrally formed thereon are arranged in mirror symmetry to one another. An embodiment which is further optimised with a view to practical use is characterised in this case in that the portions acting in torsion extend parallel to one another.

Provided it is ensured that they apply an adequate torque to the respective portions acting in torsion in the fitted state, the supporting portions of the resilient member which are aligned at an angle to their respective associated portions acting in torsion may be of any desired shape. However, support for the relevant supporting portions which saves space and is at the same time particularly secure is obtained if they are bent through an angular range of more than 90°. This being the case, the resilient member which is provided in accordance with the invention is of a shape approximating to that of a conventional S-shaped or W-shaped clamping clip, in which the length of each of the resilient arms which point towards the associated rail is so much reduced that they do not touch the foot of the rail.

Where the rail is supported on the solid base via an elastic layer, it may be advantageous, to minimise the emitted sounds, for the elastic layer to cover at least the foot of the rail and the web of the rail.

The invention will be explained in detail below by reference to the drawings, which show an embodiment. In the drawings, which are schematic:

DESCRIPTION OF THE PREFERRED EMBODIMENTS

Figure 1:
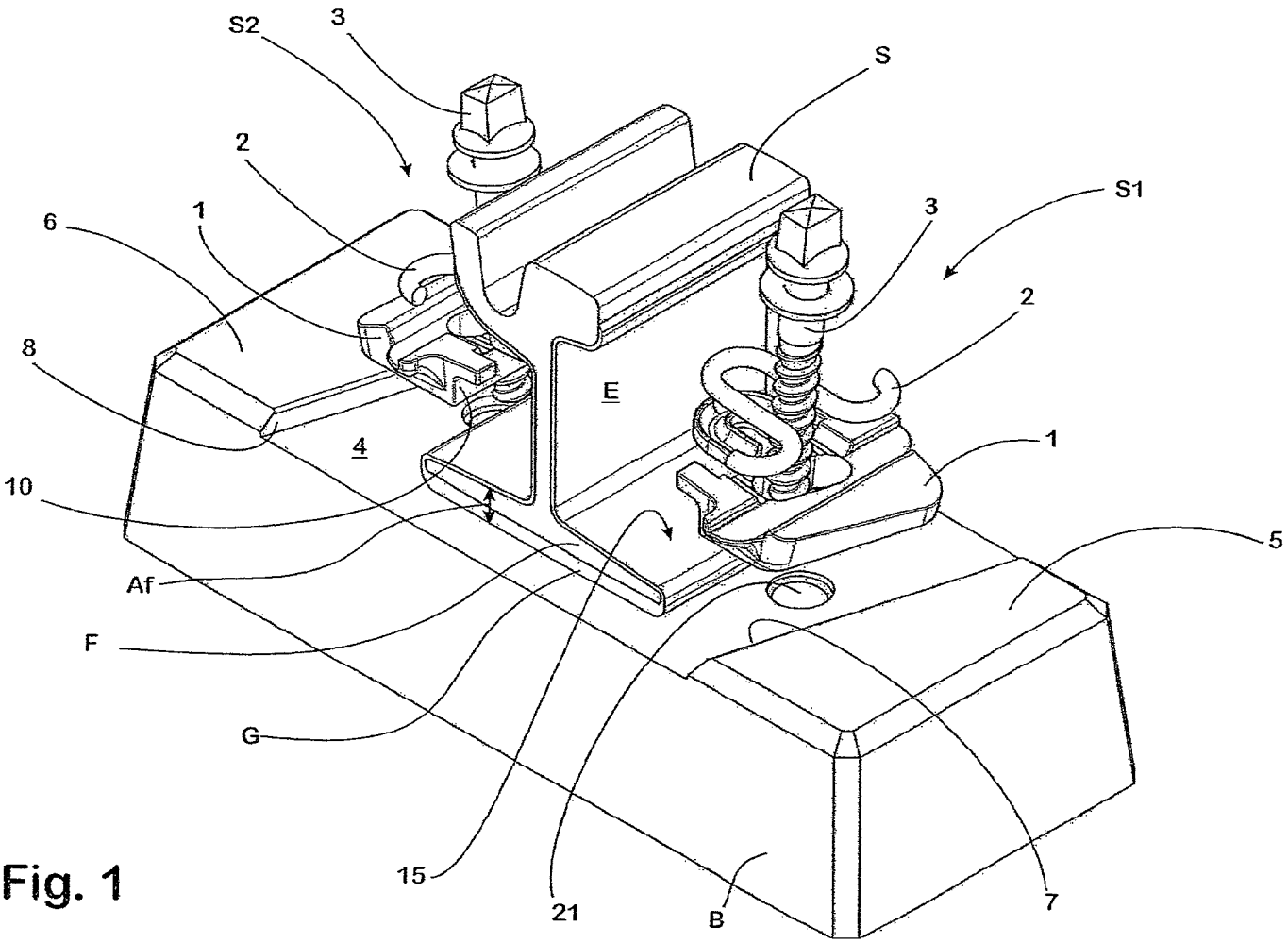
FIG. 1 is an exploded view of a fastening for a tramway rail.
Figure 2:
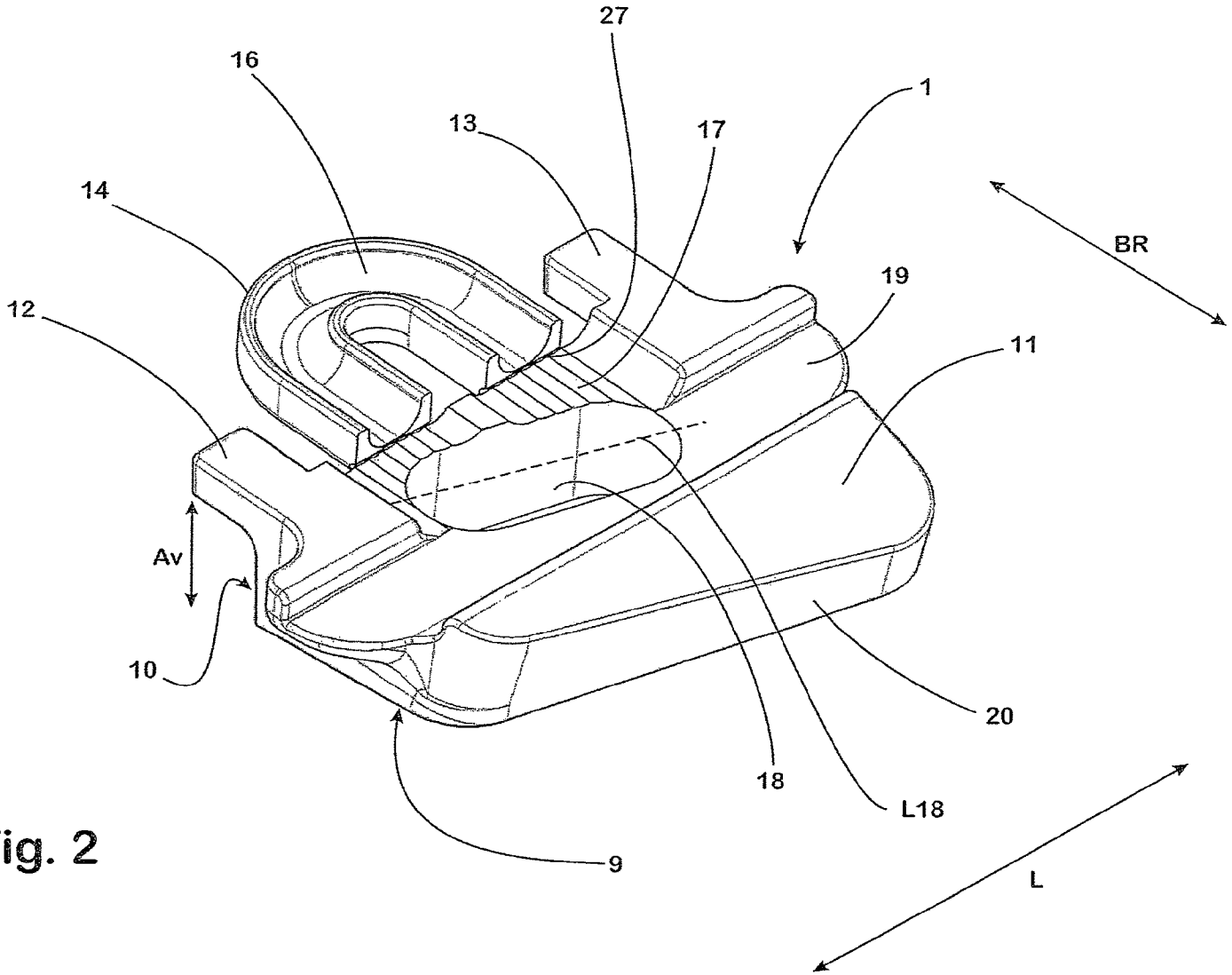
FIG. 2 is a perspective view of a guide plate which is used to fasten the tramway rail in place.
Figure 6:
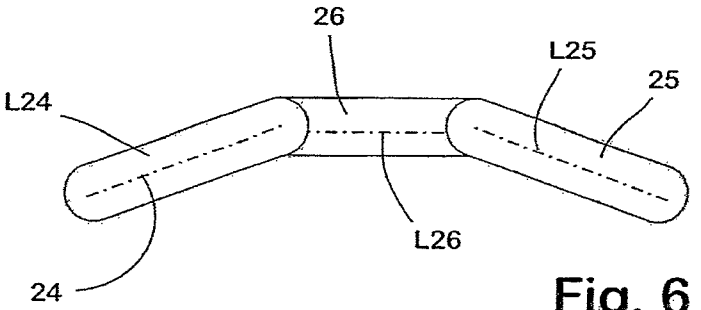
FIG. 6 is a view of the resilient member from the front.
Figure 3:
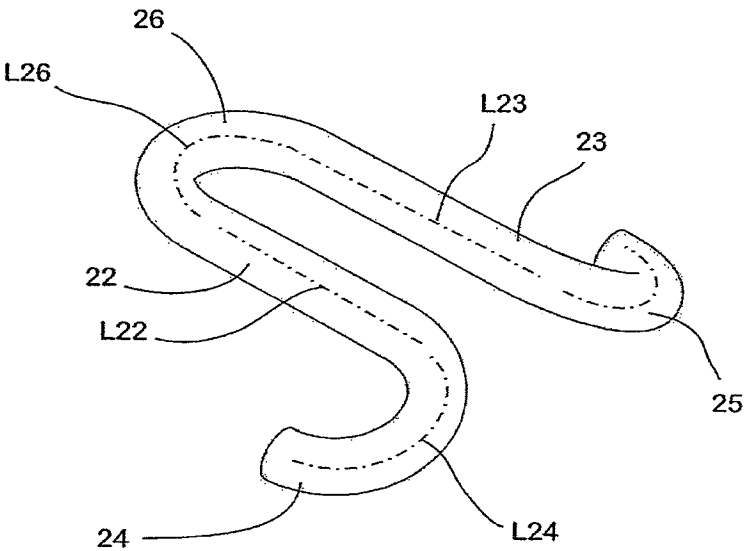
FIG. 3 is a perspective view of a resilient member which is used to fasten the tramway rail in place.
Figure 5:
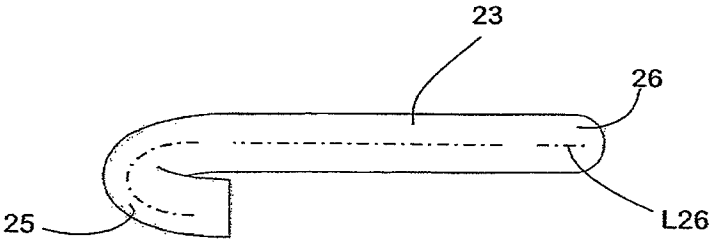
FIG. 5 is a view of the resilient member from the side.
Figure 4:
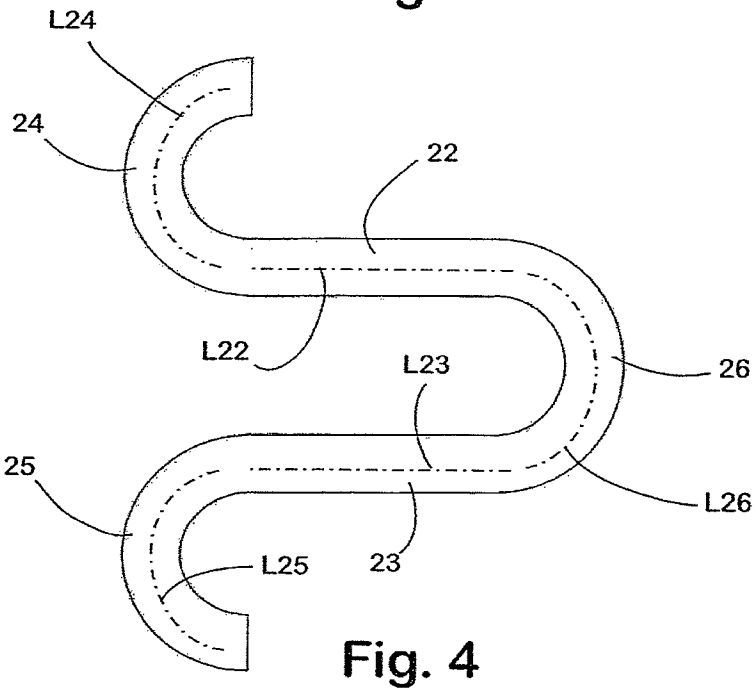
FIG. 4 is a plan view of a resilient member as shown in FIG. 3.

The rail S takes the form of a type of grooved rail and the fastening thereof to a solid base formed by a concrete sleeper B is accomplished by means two systems S1, S2 of similar design which each comprise a guide plate 1, a resilient member 2 and, as a clamping member, a clamping screw 3.

Formed in the concrete sleeper B is a plane supporting surface 4 which, at its longitudinal edges, meets the longitudinal sides of the sleeper B and which is bounded by respective shoulders 5, 6 at its narrow sides. The contacting surfaces 7, 8 of the shoulders 5, 6, which are associated with the supporting surface 4 and extend parallel to one another, each meet the longitudinal edges of the supporting surface 4 at an acute angle, thus giving the supporting surface 4 the form of a parallelogram in plan.

Each guide plate 1, which is made of a non-conductive plastics material which is for example fibre-reinforced, has on its underside a supported surface 9 by which it rests on the supporting surface 4 of the sleeper B in the fitted state. Along its side associated with the foot F of the rail S, the supported surface 9 joints up with a contacting surface 10 which is aligned approximately at right angles to the supported surface 9. Except at its corner regions adjoining the upper side 11 of the guide plate 1 and in a central region which likewise adjoins the upper side 11, the contacting surface 10 extends in this case for the full height of the guide plate 1. Integrally formed on the guide plate 1 in the respective relevant corner regions are projections 12, 13 which point towards the web E of the rail S. The projections 12, 13 serve in this case to provide additional protection against the rail S or the guide plate 1 tilting.

Formed on the guide plate 1 in one piece therewith in the central region of the contacting surface 10 which is arranged centrally between the projections 12, 13 is a U-shaped projection 14 which likewise points towards the web E of the rail S. The length of the projection 14 where it projects beyond the contacting surface 10 is considerably greater in this case than the corresponding length of the projections 12, which are shaped to form stops. In the region of the transition from the projection 14 to the main body of the guide plate 1 is formed an intended break-point 27 which extends in the longitudinal direction of the contacting surface and at which the projection 14 breaks off the guide plate 1 if loaded to an appropriate degree.

The distance Av between the undersides of the projections 12, 13, 14 and the supported surface 9 of the guide plate 1 is in each case at least as large as the distance Af in the respective cases between the upper side 15 of the foot F of the rail and the supporting surface 4 of the concrete sleeper B. In this way, when the systems S1, S2 are fully fitted, a very low hold-down force is, at most, exerted on the foot F of the rail by means of each of the projections 14, or rather by means of a central loop of the resilient member 2 which is guided therein.

Formed in the upper side of the central projection 14 is a trough-like guiding track 16 which follows the U-shape of the projection 14.

Formed in addition in the upper side 11 of the guide plate 1, in the region of the transition from the projection into the main body of the guide plate 1, are trough-like keying surfaces 17 whose alignment corresponds to the alignment of the projections 12-14.

As well as this, there is also formed in the guide plate 1 a through-opening 18 in the form of a slotted hole which runs from the upper side 11 of the guide plate 1 to its supported surface 9. The longitudinal axis L18 of the through-opening 18 is so aligned in this case that it intersects the contacting surface 10 at an acute angle.

What is more, there is recessed into the upper side 11 of the guide plate 1 a strip-like support surface 19 which extends for the length L of the guide plate 1.

Finally, there is formed at the rear side of the guide plate opposite from the contacting surface 10 a further support surface 20 which is aligned parallel to the longitudinal axis L18 of the through-opening 18 and substantially perpendicularly to the supported surface 9 of the guide plate 1. The guide plates 1 are supported against the respective associated contacting surfaces 7 and 8 of the shoulders 5 and 6 of the concrete sleeper 5 by means of the support surfaces 20. This being the case, the position of the rail in the widthwise direction BR can be adjusted, for the purpose of setting the gauge of the track to which the rail S belongs, by shifting the given guide plate 1 in the longitudinal direction of the associated contacting surface 7, 8. The distance for which this adjustment can be made is limited by the length of the through-opening 18.

The clamping screw 3 for the systems S1, S2 is in each case a conventional coach-screw. For the screws to be fastened in place, there are provided in the sleeper B respective openings 21 in which are fitted anchor plugs of plastics material (not shown).

The resilient member 2 is of a shape approximating to a W which exhibits mirror symmetry and comprises two portions 22, acting in torsion which are arranged parallel to one another, the two portions 22, 23 acting in torsion being connected into respective supporting portions 24, 25 at one end and being connected together by a further supporting portion 26 at their other ends. The first supporting portions mentioned, 24, 25, are bent round from the respective portions 22, 23 acting in torsion to a downward angle relative to the portions 22, 23 acting in torsion and each extend in the form of an arc through an angular range of approximately 180°. In the same way, the supporting portion 26 which connects the portions 22, 23 acting in torsion together is of a semicircular form. However, its longitudinal axis L26 extends in the same plane as the longitudinal axes L22, L23 of the portions 22, 23 acting in torsion, whereas the longitudinal axes L24 and L25 of the supporting portions 24, 24 pass through the plane defined by the longitudinal axes L22, L23 at an acute angle. Together with the portions 22, 23 acting in torsion, the supporting portion 26 forms the central loop of the resilient member 2.

The foot F and web E of the rail are completely covered with a layer G of an elastic material. When the fastening for the rail S is fully fitted, this ensures on the one hand a defined ability to yield for the rail S and on the other hand minimised emitted sound when travel takes place along it.

For the fastening to be fitted, the rail S is set down, by its foot F which is sheathed in the elastic layer G, on the supporting surface 4 of the sleeper B. The guide plates 1 of the systems S1, S2 are then so positioned that, when the prescribed gauge is properly observed, the rail S is guided laterally between the shoulders 5, 6 of the sleeper B with substantially no clearance. The foot F of the rail rests against the contacting surfaces 10 of the guide plates 1 by its longitudinal sides in this case. The resilient members 2 are then placed down on the guide plates 1 in such a way that their free supporting portions 24, 25 are seated on the support surface 19 of the guide plate 1. The length of the portions 22, 23 acting in torsion of the resilient member 5 is selected to be such in this case that the portions 22, 23 acting in torsion and the supporting portion 26 which connects them together project beyond the contacting surface 10 and are guided in the guiding track 16 formed in the projection 16.

Each clamping screw 3 is then screwed into the opening 21 associated with it in the sleeper S until the given resilient member 2 has been pressed, by means of the head of the clamping screw 3, sufficiently far towards the guide plate 1 associated with it for an adequate elastic hold-down force to act on the guide plates 1 as a result of the twisting of the portions 22, 23 acting in torsion which is all part of the pressing-down. If the rail S moves in the vertical direction perpendicular to the supporting surface 4 when a rail-borne vehicle travels along it and in so doing impacts against one of the projections 12-14, this impact is absorbed elastically by the resilient members 2. In this way, the respective clamping screws 3 of the systems S1, S2 are protected against excessive impacts, and in this way the risk of the fastening coming loose prematurely is reliably prevented.

If, when fitting is taking place or in ongoing practical operation, there is a high load on the resilient member 2, the projection 14 breaks off at the intended break-point and the central loop of the resilient member 2 is thus supported on the foot F of the rail. The intended break-point thus ensures that, even if there is a load which exceeds the intrinsic elasticity of the projection 14 as a result of, for example, a particularly large movement of the foot of the rail in the vertical direction, this load is kept away from the fastener fastening the guide plate 1 in place and is resiliently absorbed.

Figure 7:
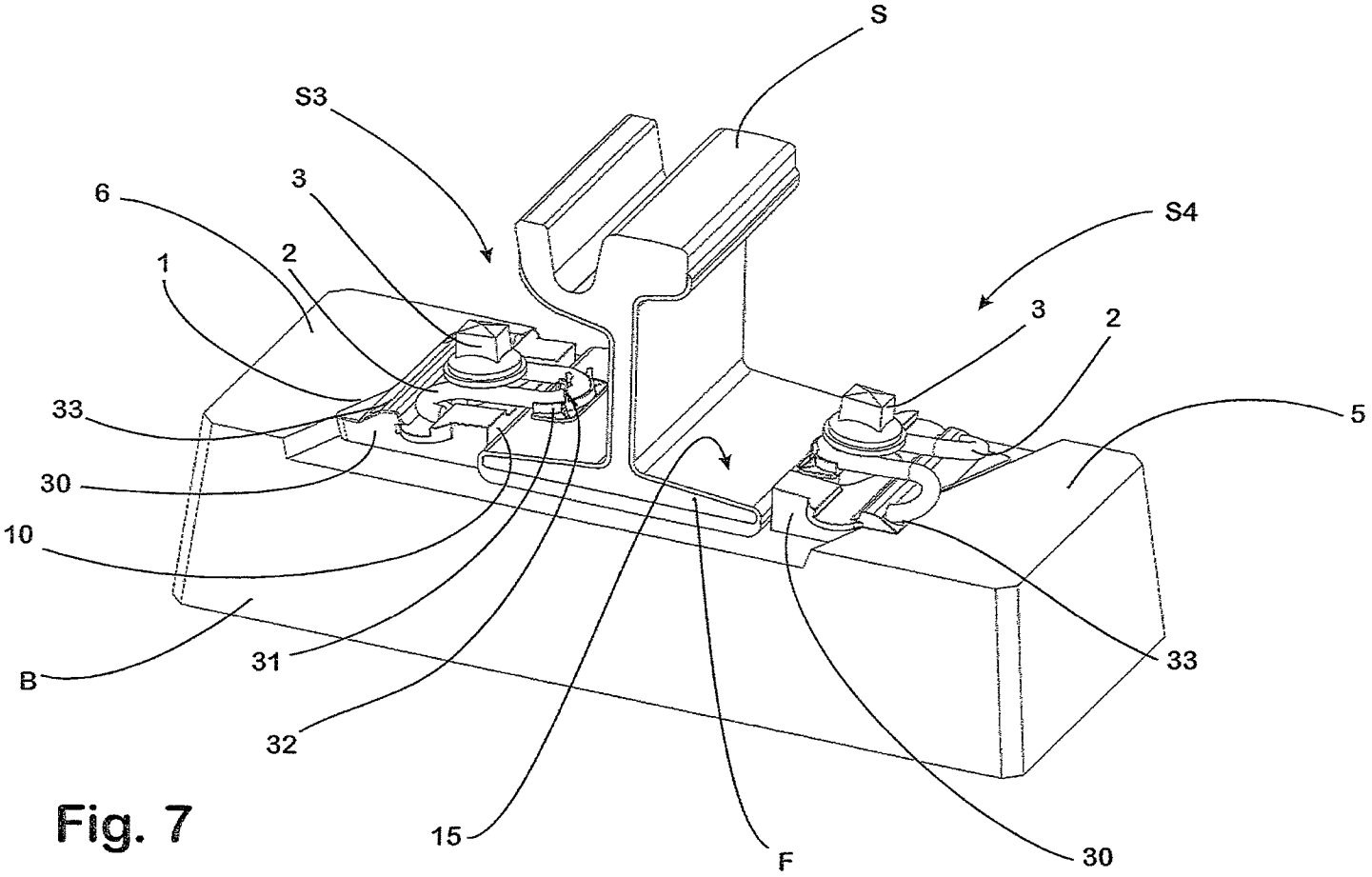
FIG. 7 is a perspective view of an alternative embodiment of rail fastening.

In FIG. 7, which shows an alternative embodiment of rail fastening according to the invention, those components which are used in this fastening and which were also used in the fastening described above have been given the same reference numerals as in FIGS. 1 to 6.

In the fastening shown in FIG. 7 for the rail S, as in the fastening shown in FIG. 1, two systems S3, S4 are used of which one is arranged on one side of the rail S and the other is arranged on the other side thereof. The system S3 which is shown on the left-hand side in FIG. 7 is in the fully fitted state, whereas the system S4 arranged on the right-hand side is shown in an initial fitted state.

The systems S3, S4 each comprise a resilient member 2, a clamping member 3 in the form of a clamping screw, a guide plate 30 and an insulating member 31. In contrast to the guide plate 1 which is provided in the case of the systems S1, S2, there is no shaped member comparable to the projections 12, 13 or 14 integrally formed on the guide plate 30, and the guide plates 30 are thus bounded in the direction of the rail S by their contacting surfaces 10. Hence, in the case of the systems S3, S4, the further supporting portion 26 of the given resilient member 2 and those end regions of the portions 22, 23 acting in torsion thereof which are associated with this supporting portion do not rest on a projection which, in its original state, is solidly connected to the given guide plate but project freely over the given guide plate 30 towards the rail S. However, in this embodiment too the portions 22, 23 acting in torsion are still supported on the guide plate 30 for the major proportion of their length and because of this, in the systems S3, S4 too, the hold-down forces which, when the rail S is not under a load, the given resilient member 2 exerts in the fully fitted state on the foot F of the rail covered by the elastic layer G are only minimised ones.

The insulating member 31, which is made of a non-conductive material, is positioned between the foot F of the rail and the further supporting portion 26 which is arranged above this latter, and is coupled to the supporting portion 26, detachably but in such a way that it cannot be lost, by means of a latching connection 32. On its side associated with the foot F of the rail, the insulating member 31 has a plane supported surface by means of which the low forces applied by the resilient member 2 are applied to the elastic layer G with an even distribution. In this respect, the function of the insulating member 31 is the same as the function of the projection 14 provided in the systems S1, S2 once the projection 14 has been separated from the given guide plate 1 as a result of a fracture at the intended break-point 27.

To make it easier for the systems S3, S4 to be initially fitted in an exact position, recesses 33 which are open in the upward direction and towards the side remote from the rail S are formed in that side of the guide plates 30 which is remote from the contacting surface 10. As shown in the right-hand part of FIG. 7, the ends of the first supporting portions 24, of the resilient members 2 are seated in these recesses 33 in the initial fitted position.

The invention thus relates to a system S1, S2, comprising a guide plate 1, 30, a fastening member 3 and a resilient member 2, for fastening a rail S to a solid base B. The guide plate 1, 30 serves in this case as a guide for the rail S in the horizontal direction and as a stop for movements of the rail S in the vertical direction. For this purpose, the guide plate 1, 30 has a contacting surface 10 against which the foot F of the rail rests by its longitudinal side in the fitted position. Integrally formed on the guide plate 1, 30 as a option is at least one projection 14 which projects beyond the contacting surface 10 towards the associated rail S and which rests on the rail S with a minimised hold-down force and which itself forms the stop for the vertical movements of the rail S. The resilient member 2 which rests on the guide plate 1, 30 is so designed and in the fitted state is so supported on the associated guide plate 1, 30 that it exerts substantially no hold-down force on the rail S but merely supports the guide plate 1, 30 elastically against the clamping member 3 which is used to fasten it in place. For this purpose, the resilient member is of a W-shaped or S-shaped configuration and, at a portion forming a central loop comprising the two portions 22, 23 acting in torsion and the supporting portion 26 situated between them, projects sufficiently far over the foot F of the rail for the foot F of the rail to be retained resiliently by the resilient member 2 if it is moved upwards away from the solid base B in the vertical direction.

REFERENCE NUMERALS

1, 30 Guide plate
2 Resilient member
3 Clamping screw (clamping member)
4 Supporting surface of the sleeper B
5, 6 Shoulders of the sleeper B
7, 8 Contacting surfaces of the shoulders 5, 6
9 Supported surface of the guide plate 1, 30
10 Contacting surface of the guide plate 1, 30
11 Upper side of the guide plate 1, 30
12, 13 Projections from the guide plate 1
14 U-shaped projection from the guide plate 1
15 Upper side of the foot F of the rail
16 Guiding track in the projection 14
17 Keying surfaces on the guide plate 1, 30
18 Through-opening in the guide plate 1, 30
19 Support surface on the guide plate 1, 30
20 Rear support surface on the guide plate 1, 30
21 Opening in the sleeper
22, 23 Portions acting in torsion of the resilient member 3
24, 25, 26 Supporting portions of the resilient member 3
27 Intended break-point
30 Guide plate
31 Insulating member
32 Latching connection
33 Recesses
Av Distance between the undersides of the projections 12, 13, 14 and the supported surface 9 of the guide plate 1, 30
Af Distance Af between the upper side 15 of the foot F of the rail and the supporting surface 4 of the concrete sleeper B
B Concrete sleeper
BR Widthwise direction
E Web of the rail S
F Foot of the rail S
G Elastic layer
L Length of the guide plate 1, 30
L18 Longitudinal axis of the through-opening 18
L22, L23 Longitudinal axes of the portions 22, 23 acting in torsion
L26 Longitudinal axis of the supporting portion 26
L24, L25 Longitudinal axes of the supporting portions 24, 25
S Rail
S1, S2 Systems for fastening the rail S in place

The invention claimed is:

1. A system for fastening a rail in place on a base, the system comprising:

a guide plate which has a supported surface by which it is supported on the base in a fitted position, a contacting surface which is associated with a foot of the rail which is to be fastened in place, and a through-opening which runs from an upper side of the guide plate to the supported surface of the guide plate, a clamping member insertable through the through-opening in the guide plate and fastenable to the base, and a resilient member bent from a spring wire which has at least one portion acting in torsion at one end of which is formed a first supporting portion aligned at an angle to the portion acting in torsion and at the other end of which is formed a further supporting portion bent round from the portion acting in torsion, the length and angular position of the first supporting portion relative to the portion acting in torsion being of a size such that in the fitted position the first supporting portion is supported on an associated support surface on the guide plate and the resilient member being braced against the base by means of the clamping member in such a way that the portion acting in torsion exerts an elastic restorative force, the length of the portion acting in torsion being of a size such that, in the fitted position, that end of the portion acting in torsion which is associated with the further supporting portion projects beyond the contacting surface of the guide plate towards the rail, and the further supporting portion, starting with its one end from the assigned portion acting in torsion, being so bent back to the guide plate that it is likewise supported with its other end on the guide plate in the fitted position and forms a fixed point for the torsion on the portion acting in torsion, the further supporting portion forming a stop for a vertical movement of the rail.

2. The system according to claim 1, wherein the guide plate has at least one projection which projects over the contacting surface towards the associated rail and which projects over a free upper side of the foot of the rail in the fitted position.

3. The system according to claim 2, wherein at least the further supporting portion or the portion acting in torsion rests on the projection from the guide plate in the fitted position, and the projection has on its upper side at least one guide for the further supporting portion or the portion acting in torsion.

4. The system according to claim 1, wherein the guide plate has, on its opposite side from the contacting surface, a support surface having a longitudinal axis which intersects the contacting surface at an acute angle, and in that there is formed on the solid base a shoulder against which the guide plate is supported by its support face in the fitted position.

5. The system according to claim 4, wherein the through-opening in the guide plate takes the form of a slotted hole whose longitudinal axis is aligned parallel to the longitudinal axis of the support surface.

6. The system according to claim 4, wherein keying surfaces are formed in the upper side of the guide plate, and in that the resilient member is supported in one of the keying surfaces in the fitted position as a function of the given position of the guide plate relative to the clamping member.

7. The system according to claim 1, wherein the guide plate is made of an electrically insulating material.

8. The system according to claim 1, wherein the clamping member is a screw whose head, in the fitted position, acts on the portion acting in torsion of the resilient member.

9. The system according to claim 1, wherein a longitudinal axis of the further supporting portion of the resilient member extends in the same plane as a longitudinal axis of the portion acting in torsion.

10. The system according to claim 1, wherein the resilient member has a second portion acting in torsion arranged at a distance from the first portion acting in torsion, wherein the second portion acting in torsion, like the first portion acting in torsion, merges at one of its ends into a supporting portion which is aligned at an angle to the second portion acting in torsion and which causes a torsion on the associated portion acting in torsion in the fitted position, and wherein the second portion acting in torsion is connected at its other end to that end of the further supporting portion which is remote from the first portion acting in torsion.

11. The system according to claim 9, wherein the first and second portions acting in torsion extend parallel to one another.

12. The system according to claim 9, wherein the supporting portions which are aligned at an angle to their respective associated portions acting in torsion are bent through an angular range of more than 90°.

13. The system according to claim 1, wherein the system further comprises a sleeper or isolated support formed from a solid material, which forms the solid base.

14. The system according to claim 2, wherein the projection is formed on the guide plate in one piece therewith.

15. The system according to claim 1, wherein an intended breakpoint is formed in the region of the transition from the projection to the main body of the guide plate.

16. A fastening for fastening a rail to a solid base by means of a system formed in accordance with claim 1.

17. The fastening according to claim 16, wherein the rail stands on the solid base via an elastic layer.

18. The fastening according to claim 16, wherein the elastic layer covers at least the foot and the web of the rail.

19. The fastening according to claim 16, wherein the distance between the underside of the projection, which underside is associated with the foot of the rail which is to be fastened in place, and the supported surface of the guide plate is substantially the same as the distance between the free surface of the foot of the rail and the surface of the solid base.

* * * * *